United States Patent [19]

Currey

[11] Patent Number: 4,776,483

[45] Date of Patent: Oct. 11, 1988

[54] FUEL TANK ACCESS PLATE

[75] Inventor: Larry B. Currey, Rockwall, Tex.

[73] Assignee: CMT Industries, Inc., Rockwall, Tex.

[21] Appl. No.: 102,357

[22] Filed: Sep. 29, 1987

[51] Int. Cl.[4] ..... B65D 45/00

[52] U.S. Cl. ..... 220/327; 220/378

[58] Field of Search ..... 220/327, 378

[56] References Cited

U.S. PATENT DOCUMENTS

| | | | |
|---|---|---|---|
| 2,249,497 | 7/1941 | Samans | 220/327 |
| 2,517,012 | 8/1950 | Miller | 220/327 |
| 2,978,004 | 4/1961 | Smith | 220/327 |
| 4,579,248 | 4/1986 | Gorges | 220/327 |

*Primary Examiner*—George T. Hall

*Attorney, Agent, or Firm*—Richards, Harris, Medlock & Andrews

[57] ABSTRACT

A Fuel Tank Access Plate (10) is provided for mounting on a fuel tank (12) formed of cross linked polyethylene. The access plate (10) includes an inner plate (14) which has a pair of seal ridges (24, 26) which engage the inner surface of the fuel tank in sealed engagement. The inner plate (14) and an outer ring (16) are secured together by screws (20) which clamp the access plate (10) to the fuel tank (12) and urge the seal ridges into sealing engagement with the fuel tank. The inner plate (14) is provided with ports (54, 62) for movement of fuel to and from the tank and also provides a mount for a combination visual fuel gauge and fuel sender assembly (34).

8 Claims, 2 Drawing Sheets

FUEL TANK ACCESS PLATE

TECHNICAL FIELD

This invention relates to a fuel tank, particularly a fuel tank adapted for use in recreational motor boat.

BACKGROUND OF THE INVENTION

The majority of power boats in use today use either gasoline or diesel fuel. Reasonable prudence, and U.S. Coast Guard requirements, stipulate that the tanks used to store such fuels should be made as safe as possible from fire and explosion hazards. The tanks must be rugged enough to resist leakage after being subjected to the vibration and other motion of motor boat operation, and must be properly sealed to prevent the volatile vapors of the fuels from escaping exterior the tank.

Fuel tanks made of cross linked polyethylene have become popular in the boating industry. The polyethylene tanks are quite resistant to vibration and impact. Further, the polyethylene tanks will not rust or degrade in service. Typically, UVI stabilizers are incorporated in the polyethylene to resist degradation from ultra violet rays from the sun.

Naturally, some access is necessary through the wall of the tank to fill the tank with fuel and remove the fuel for use by the engine. Furthermore, many installations require the use of a visual fuel level gauge or fuel gauge sender as well. In certain applications, a metal access plate has been molded into the polyethylene tank to provide the various fittings and ports for these purposes. However, in use, the polyethylene swells, frequently breaking the seal formed between the polyethylene material and the metal plate and destroying the integrity of the tank. In other applications, threaded apertures have actually been formed through the wall of the polyethylene tank to receive fittings. However, during use, these threaded apertures will often be stripped and necessitate the replacement of the entire tank.

A need exists for an improved system to access a fuel tank of this type which is inexpensive, reliable and provides a secure seal to prevent the fuel vapors from escaping the tank.

SUMMARY OF THE INVENTION

In accordance with one aspect of the present invention, a fuel tank access plate for an opening in a fuel tank is provided. The fuel tank access plate includes an inner plate having a first side. The first side has a continuous seal ridge for sealed engagement with the inner surface of the fuel tank about the opening therein. An outer ring is positioned on the outer surface of the fuel tank about the opening therein. Structure is provided for fastening the outer ring to the inner plate to clamp the fuel tank access plate to the fuel tank and urge the seal ridge into sealing engagement with the fuel tank.

In accordance with another aspect of the present invention, the inner plate and outer ring are formed of nylon. First and second fuel ports are formed through the inner plate and a combined visual fuel gauge and sender is also mounted on the inner plate.

In accordance with another aspect of the present invention, the inner plate includes a second continuous seal ridge on the first side positioned entirely within the perimeter of the first continuous seal ridge. A plurality of threaded apertures are formed into the first side of the inner plate between the first and second continuous seal ridges. Corresponding apertures are formed through the wall of the fuel tank and the outer ring. Threaded fasteners can then be inserted through the aligned apertures in the outer ring and fuel tank and threaded into the apertures in the inner plate to clamp the access plate to the fuel tank.

BRIEF DESCRIPTION OF THE DRAWINGS

For a more complete understanding of the present invention and the further advantages thereof, reference is now made to the following Detailed Description, taken in conjunction with the accompanying drawings wherein.

DETAILED DESCRIPTION

Figure 1:
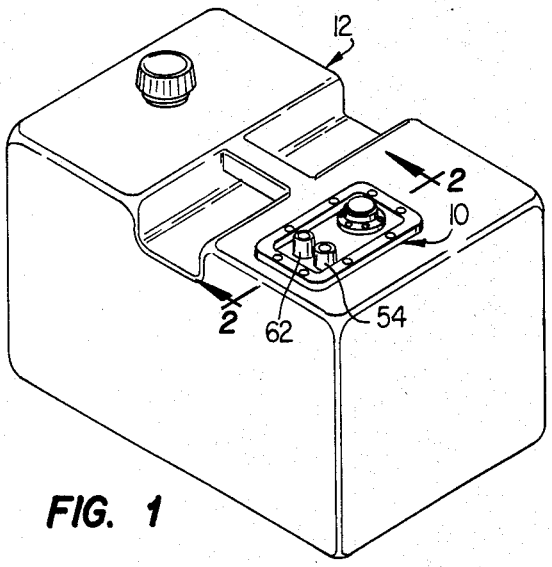
FIG. 1 is a perspective view of a fuel tank incorporating a first embodiment of the present invention.
Figure 2:
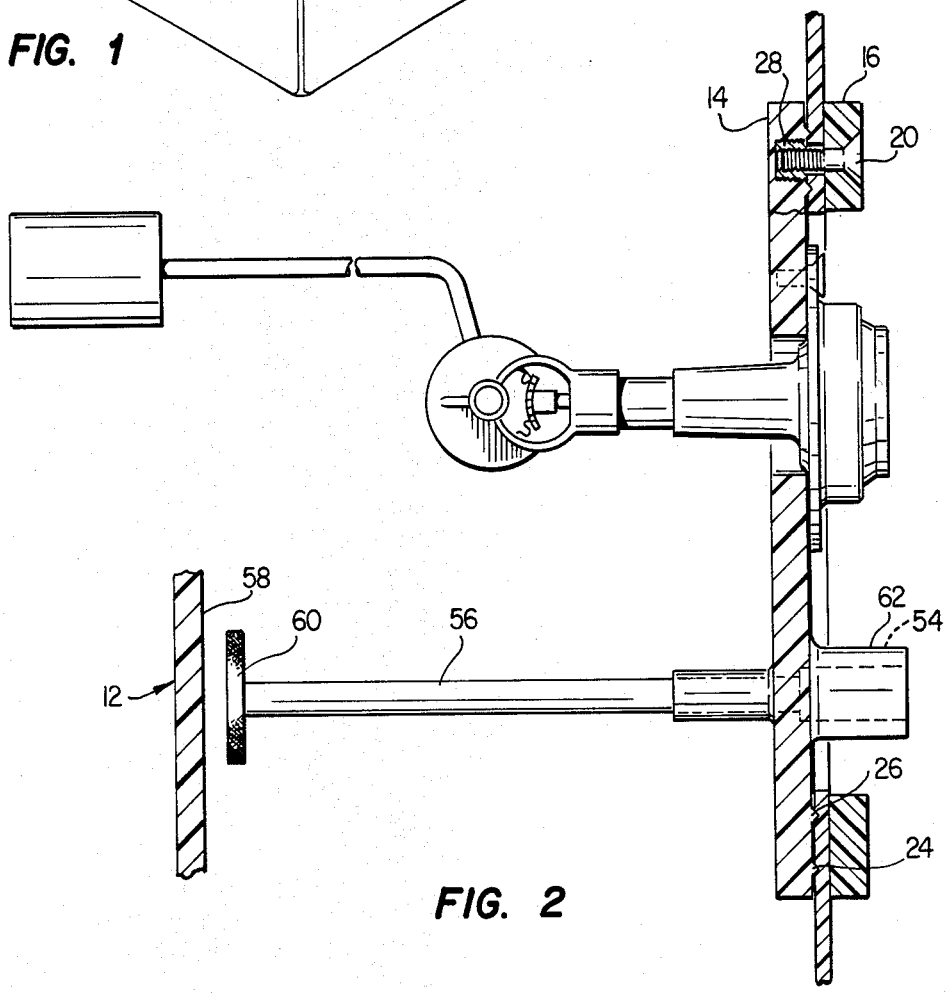
FIG. 2 is a cross sectional view of the first embodiment of the present invention.
Figure 3:
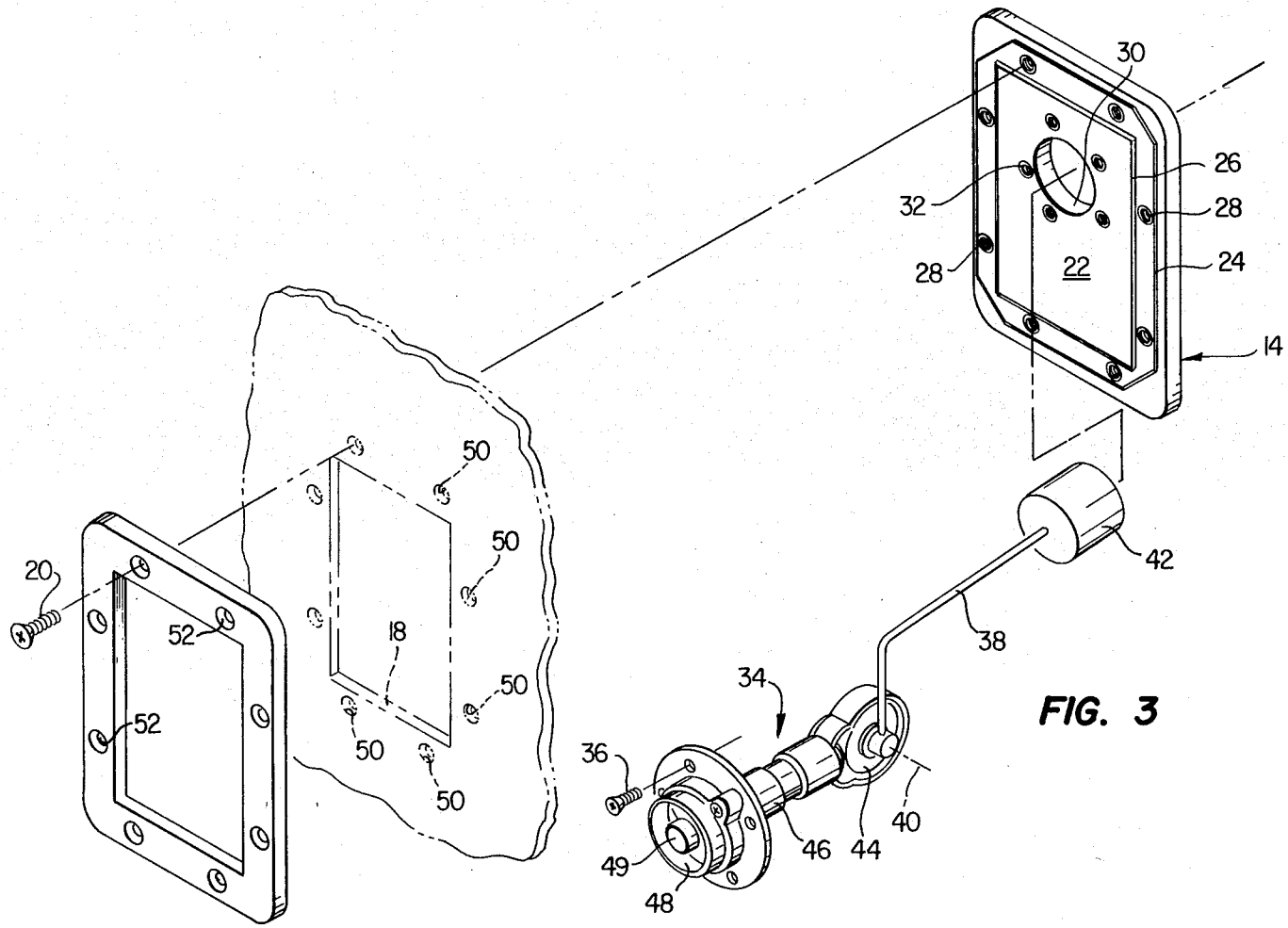
FIG. 3 is an exploded view of the first embodiment of the present invention.

With reference now to te accompanying FIGS. 1–3, a fuel tank access plate 10 forming a first embodiment of the present invention is disclosed for use with a fuel tank 12. As will be discussed hereinafter, the access plate 10 provides an inexpensive, yet effective technique for gaining access to the interior of the tank for fuel supply ports and fuel level gauges. Preferably, the fuel tank 12 is constructed of a cross linked polyethylene, such as provided by Phillips Petroleum Company or Union Carbide.

As best seen in FIGS. 2 and 3, the access plate 10 includes an inner plate 14, which is inserted through an opening 18 in the fuel tank to bear against the inner surface of the tank surrounding the opening, and an outer ring 16 which bears against the outer surface of the fuel tank about the opening. Screws 20 are employed to secure the inner plate 14 and outer ring 16 together, and to the fuel tank, as discussed hereinafter.

The inner plate 14 has a generally rectangular configuration with a first side 22. A continuous first seal ridge 24, extends outwardly from the first side about the entire periphery of the first side. A second continuous seal ridge 26 also extends around the periphery of the first side, but slightly within the first seal ridge 24. A number of threaded inserts 28 are secured in the inner plate 14 through the first side between the first and second seal ridges 24 and 26. As can best be seen in FIG. 2, the ridges are pyramid shaped in cross section to engage the inner surface of the fuel tank with sufficient pressure to form a tight seal therebetween.

A hole 30 is formed through the inner plate 14. Threaded inserts 32 are set into the inner plate 14 through the first side about hole 30. A combined visual fuel gauge and fuel sender assembly 34 can be received through hole 30 and mounted to the inner plate 14 by screws 36 received in inserts 32. The assembly 34 can be of the type manufactured by Rochester Gauge Company of Dallas, Texas. The assembly includes a sensing arm 38 pivoted for pivotal motion about an axis 40, with a float 42 at the outer end of the arm 38. The float 42, commonly of cork, will float atop the fuel in the tank and the pivotal position of the arm 38 is thus directly related to the fuel level in the tank. A gear wheel 44 mounted to the arm 38 will rotate a shaft passing through the housing 46 of the assembly as the arm pivots to provide a visual indication of the fuel level by the position of the needle visible through the clear dial 48 of the assembly and also vary the resistance of a potentiometer within the assembly which can be connected through electrical connector 49 to a fuel gauge remote from the tank.

As is best seen in FIG. 3, a series of apertures 50 are formed through the wall of the fuel tank 12 about the opening 18 which correspond to the position of inserts 28. Further, a series of counter sunk apertures 52 are formed through outer ring 16, which are also positioned in alignment with apertures 50 and inserts 28. Screws 20 can then be used to secure the ring and plate together, and to the fuel tank. As the screws 20 are tightened, the seal ridges 24 and 26 contact the inner surface of the fuel tank with sufficient force to form an effective seal.

A fuel supply port 54 is formed in the inner plate 14 which mounts a tube 56 which extends into the tank and proximate the bottom 58 of the tank. A fuel screen 60 is mounted at the end of the tube proximate the bottom 58 to filter fuel passing through the tube and out of the port 54. Preferably, the end of the tube 56 proximate bottom 58 is about ⅛ inch off the bottom 58. The bottom screen 60 preferably has an area of about 1.4 square inches, and is formed of a stainless steel 80 mesh wire screen. A return port 62 is also provided in inner plate 14 to permit fuel to return to the tank. Such a return port 62 is commonly required when the motor is fuel injected.

The fuel tank access plate 10 of the present invention provides significant advantages over the prior design. The seal formed by seal ridges 24 and 26 will easily meet the 4 psi air test required by the relevant U.S. Coast Guard standard. Further, should any of the fittings on the access plate 10 become worn, the entire access plate 10 can be replaced readily for a minimum cost.

While one embodiment of the present invention has been described in detailed herein, and shown in the accompanying drawings, it would be understood that various further modifications and substitutions of parts and elements are possible with departing from the scope and spirit of the invention.

I claim:

1. A fuel tank access plate for an opening in a fuel tank, comprising:

an inner plate having a first side, the first side having a continuous seal ridge for sealed engagement with the inner surface of the fuel tank about the opening therein;

an outer ring positioned on the outer surface of the fuel tank about the opening therein; and means for fastening the outer ring to the inner plate to clamp the fuel tank access plate to the fuel tank and urge the seal ridge into sealing engagement with the fuel tank.

2. The fuel tank access plate of claim 1 wherein the inner plate has a second continuous seal ridge positioned within the perimeter of the first continuous seal ridge and a plurality of threaded apertures formed into the inner plate through the first side between the first and second continuous seal ridges, the outer ring and wall of the fuel tank having apertures aligned with the threaded apertures in the inner plate, said fastening means comprising a plurality of threaded fasteners received in the aligned apertures of the outer ring and fuel tank and threaded into the threaded apertures in the inner plate.

3. The fuel tank access plate of claim 1 wherein said inner plate and outer ring are formed of nylon.

4. The fuel tank access plate of claim 1 wherein the inner plate has a first fuel port formed therethrough.

5. The fuel tank access plate of claim 1 wherein the inner plate mounts a combination fuel gauge and sender.

6. The fuel tank access plate of claim 4 further having a tube extending from said first fuel port to proximate the bottom of the fuel tank, the tube having a fuel filter of stainless steel 80 mesh wire screen.

7. A fuel tank access plate for an opening in a fuel tank formed of cross linked polyethylene, comprising:

a nylon inner plate having a first side, the first side having first and second continuous seal ridges for sealed engagement with the inner surface of the fuel tank about the opening therein, the second seal ridge being positioned within the perimeter of the first seal ridge, a plurality of threaded apertures being formed into the inner plate from the first side and positioned between the first and second seal ridges;

an outer ring positioned on the outer surface of the fuel tank about the opening therein, the outer ring having apertures formed therethrough, aligned with the threaded apertures in the inner plate;

threaded fasteners for fastening the outer ring to the inner plate to clamp the fuel tank access plate to the fuel tank and urge the first and second continuous seal ridges into sealing engagement with the inner surface of the fuel tank.

8. The fuel tank access plate of claim 7 having first and second fuel ports formed through the inner plate for passage of fuel and the fuel tank access plate further including a combination visual fuel gauge and fuel sender mounted on the inner plate.

* * * * *